US006345555B1

(12) United States Patent
Huang

(10) Patent No.: US 6,345,555 B1
(45) Date of Patent: Feb. 12, 2002

(54) REVERSIBLE ADJUSTABLE WRENCH

(76) Inventor: Ping Wen Huang, 1F, No. 364, Sec. 2, Chung Yang Road, Hsien-Hsi Tsun, Chang-Hua Hsien (TW)

( * ) Notice: Subject to any disclaimer, the term of this patent is extended or adjusted under 35 U.S.C. 154(b) by 0 days.

(21) Appl. No.: 09/761,677

(22) Filed: Jan. 18, 2001

(51) Int. Cl.[7] ..... B25B 13/16
(52) U.S. Cl. ..... 81/157; 81/111; 81/165
(58) Field of Search ..... 81/111, 157, 165, 81/175

(56) References Cited

U.S. PATENT DOCUMENTS 2,704,476 A * 3/1955 Listoa ..... 81/165 X
2,769,259 A * 11/1956 Healy ..... 81/165 X
2,846,912 A * 8/1958 Day ..... 81/165 X
3,541,898 A * 11/1970 Murata ..... 81/111
5,746,099 A * 5/1998 Janson ..... 81/157 X

* cited by examiner

*Primary Examiner*—James G. Smith
(74) *Attorney, Agent, or Firm*—Rosenberg, Klein & Lee

(57) ABSTRACT

A reversible adjustable wrench having a main body on which a slidable first jaw and a pivotally rotatable second jaw are disposed. In normal state, a leaning section of the second jaw is leant against a stop block to prevent the second jaw from being pivotally rotated. By means of rotating a spiral rod, the gap between the first and second jaws can be adjusted to snugly clamp different sizes of nuts or bolts. After moving the stop block, the second jaw has a space for pivotal rotation, permitting the wrench to be reversely wrenched.

5 Claims, 7 Drawing Sheets

REVERSIBLE ADJUSTABLE WRENCH

BACKGROUND OF THE INVENTION

The present invention is related to a reversible adjustable wrench, and more particularly to a reversible adjustable wrench in which a second jaw can be pivotally rotated to have a space for avoiding a bolt, permitting the wrench to be reversely wrenched.

FIG. 7 shows a conventional adjustable wrench. The wrench main body 8 has a fixed jaw 81. A spiral rod 83 is pivotally disposed on the main body 8 for adjusting a movable jaw 82. By means of rotating the spiral rod 83, the gap between the fixed jaw 81 and the movable jaw 82 can be adjusted for wrenching different sizes of nuts or bolts.

In use, the spiral rod 83 is first rotated to adjust the gap between the fixed jaw 81 and the movable jaw 82 to meet the size of a work piece. Then the main body 8 is turned to wrench the work piece. However, in the case that the work piece is positioned in a narrow space and it is impossible for a user to completely wrench the wrench, the user will have to first wrench the main body 8 to a certain position and then retreat the movable and fixed jaws 82, 81 from the work piece. Then the main body 8 is restored to the position prior to wrenching and then the movable and fixed jaws 82, 81 are extended to again clamp and wrench the work piece. Such operation must be repeated for tightening or untightening the work piece. This is quite troublesome to the user.

SUMMARY OF THE INVENTION

It is therefore a primary object of the present invention to provide a reversible adjustable wrench having a main body on which a slidable first jaw and a pivotally rotatable second jaw are disposed. When moving a stop block backward, a leaning section of the second jaw is free from the stopping force of a stop block, whereby the second jaw has a space for pivotal rotation. When the jaw section of the second jaw is moved back, a sufficient space is defined between the first jaw and the jaw section of the second jaw for avoiding a nut or a bolt. Accordingly, the wrench can be reversely wrenched.

The present invention can be best understood through the following description and accompanying drawings wherein:

DETAILED DESCRIPTION OF THE PREFERRED EMBODIMENTS

Figure 1:
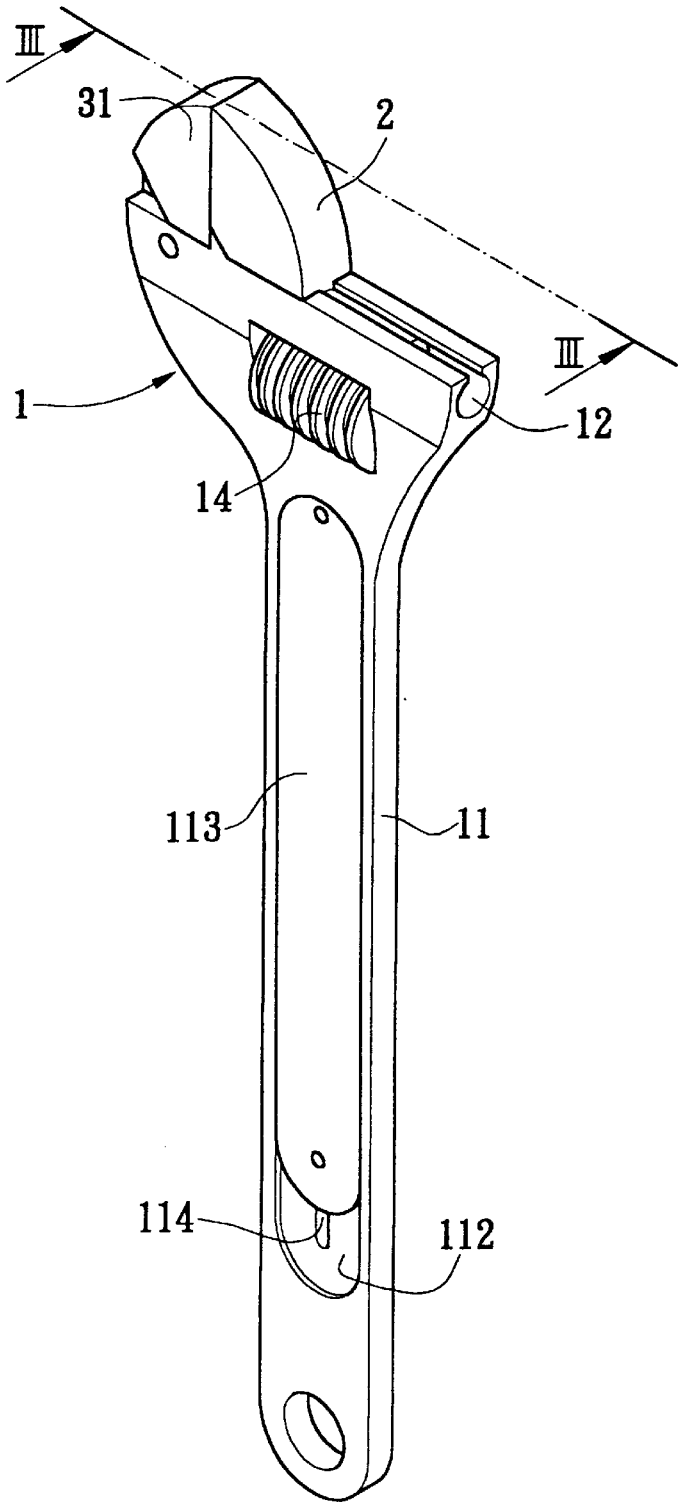
FIG. 1 is a perspective assembled view of the present invention.
Figure 2:
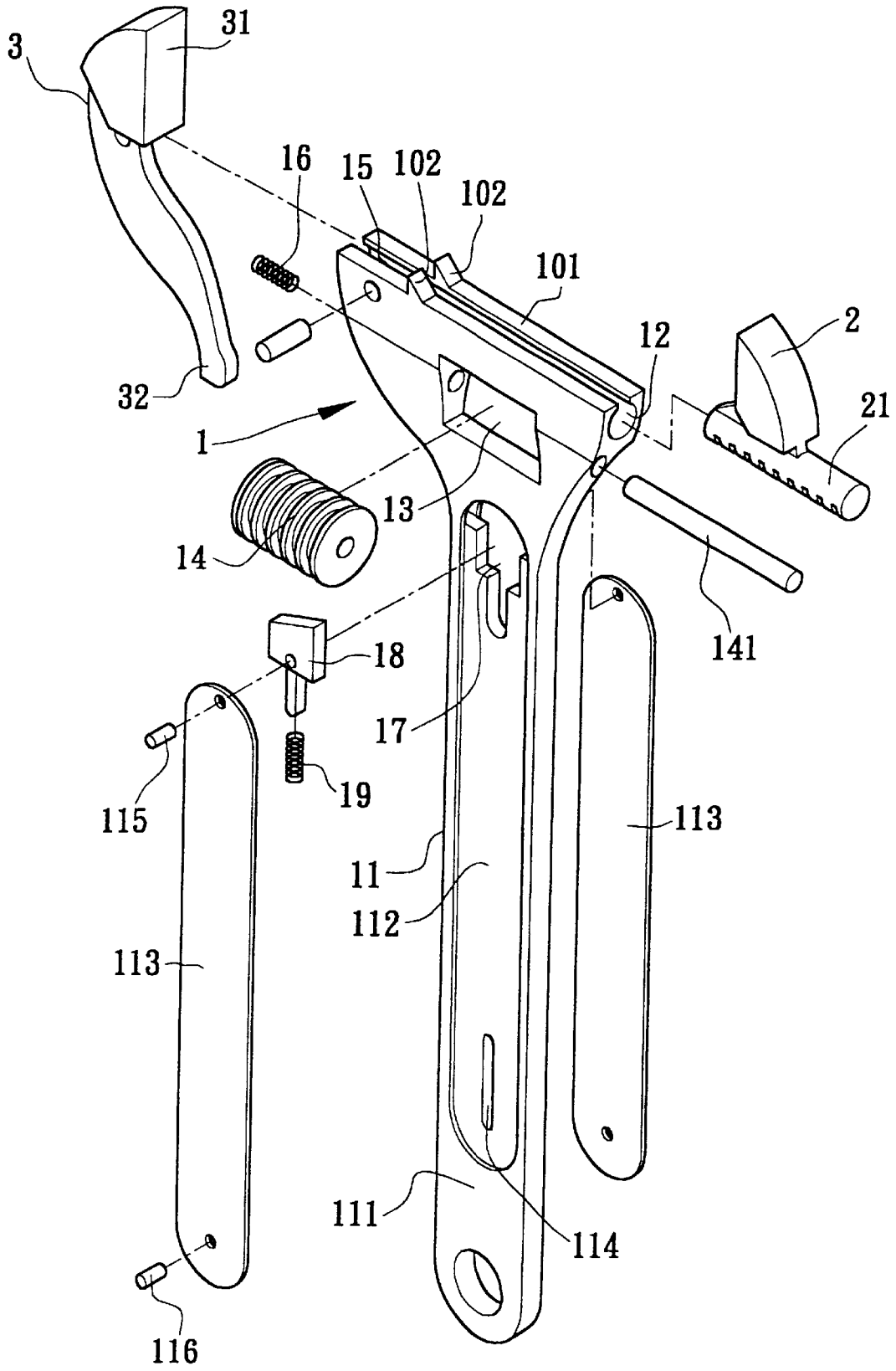
FIG. 2 is a perspective exploded view of the present invention.
Figure 3:
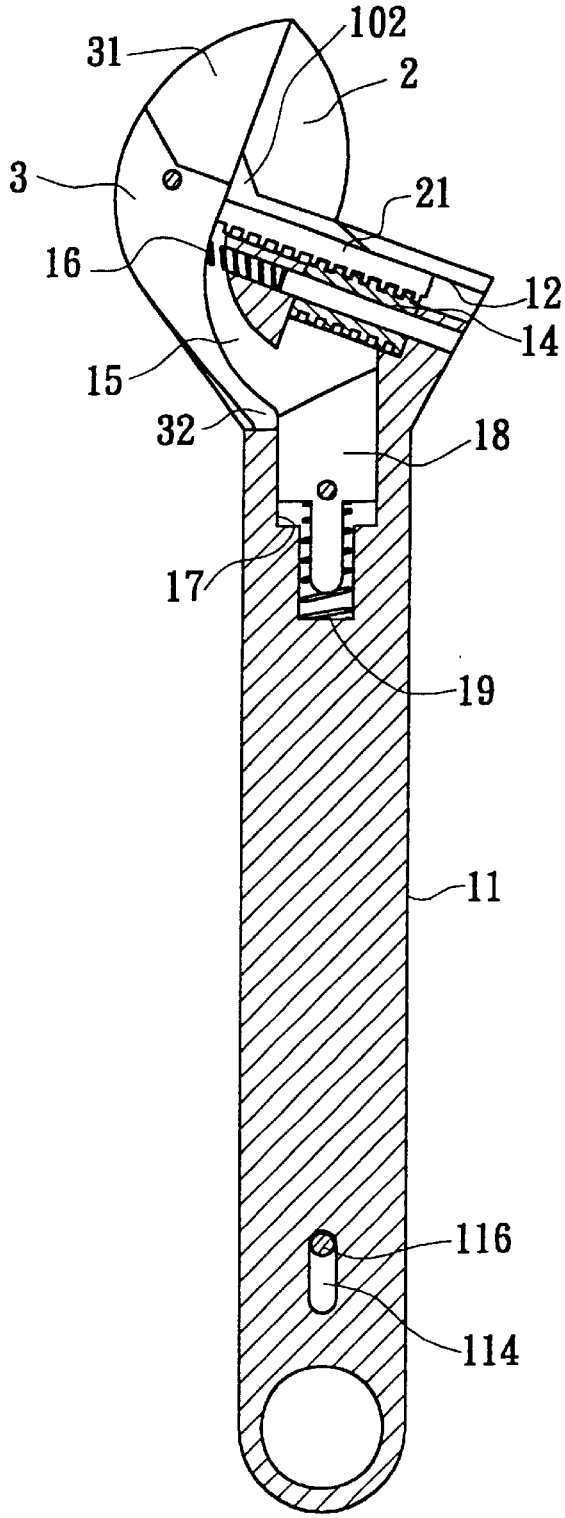
FIG. 3 is a sectional view taken along line III—III of FIG. 1.

Please refer to FIGS. 1 to 3. The reversible adjustable wrench of the present invention includes a main body 1 having an elongated grip section 11. One end of the main body 1 opposite to the grip section 11 is formed with a slide channel 12. A rack 21 of a first jaw 2 is fitted in the slide channel 12, whereby the first jaw 2 can be slided along the slide channel 12. The main body 1 is formed with a first perforation 13 in which a spiral rod 14 meshing with the rack 21 is pivotally disposed via a rod member 141. One side of the main body 1 opposite to the first jaw 2 is formed with a hollow section 15 in which a second jaw 3 is pivotally disposed. The second jaw 3 has a jaw section 31 extending out of one end of the hollow section 15 opposite to the grip section 11. The main body 1 has an end face 101 opposite to the grip section 11. A projecting stop section 102 is formed on the end face 101. The jaw section 31 of the second jaw 3 abuts against the stop section 102, whereby the jaw section 31 and the end face 101 contain a certain angle. One end of the second jaw 3 opposite to the jaw section 31 is formed with an extending leaning section 32. A first spring 16 is positioned between the main body 1 and the second jaw 3 for resiliently pushing the second jaw 3 to pivotally rotate. Therefore, in normal state, the jaw section 31 of the second jaw 3 is kept leant on the stop section 102. The main body 1 is further formed with a second perforation 17 in which a stop block 18 is positioned. A second spring 19 is placed between the stop block 18 and a side wall of the second perforation 17 for resiliently pushing the stop block 18. Therefore, in normal state, the leaning section 32 of the second jaw 3 is leant on the stop block 18 without rotation.

The grip section 11 has a substantially rectangular cross-section. Each of two opposite lateral faces 111 of the grip section 11 is formed with a depression 112 communicating with the second perforation 17. Two slide blocks 113 are respectively disposed in the depressions 112. The two slide blocks 113 are connected with the stop block 18 by a first pin member 115. One end of the grip section 11 opposite to the second perforation 17 is formed with a slot 114 in the depression 112. A second pin member 116 is passed through the slot 114 to connect the two slide blocks 113, whereby when pushing either of the two slide blocks 113, the stop block 18 is driven and moved.

Figure 4:
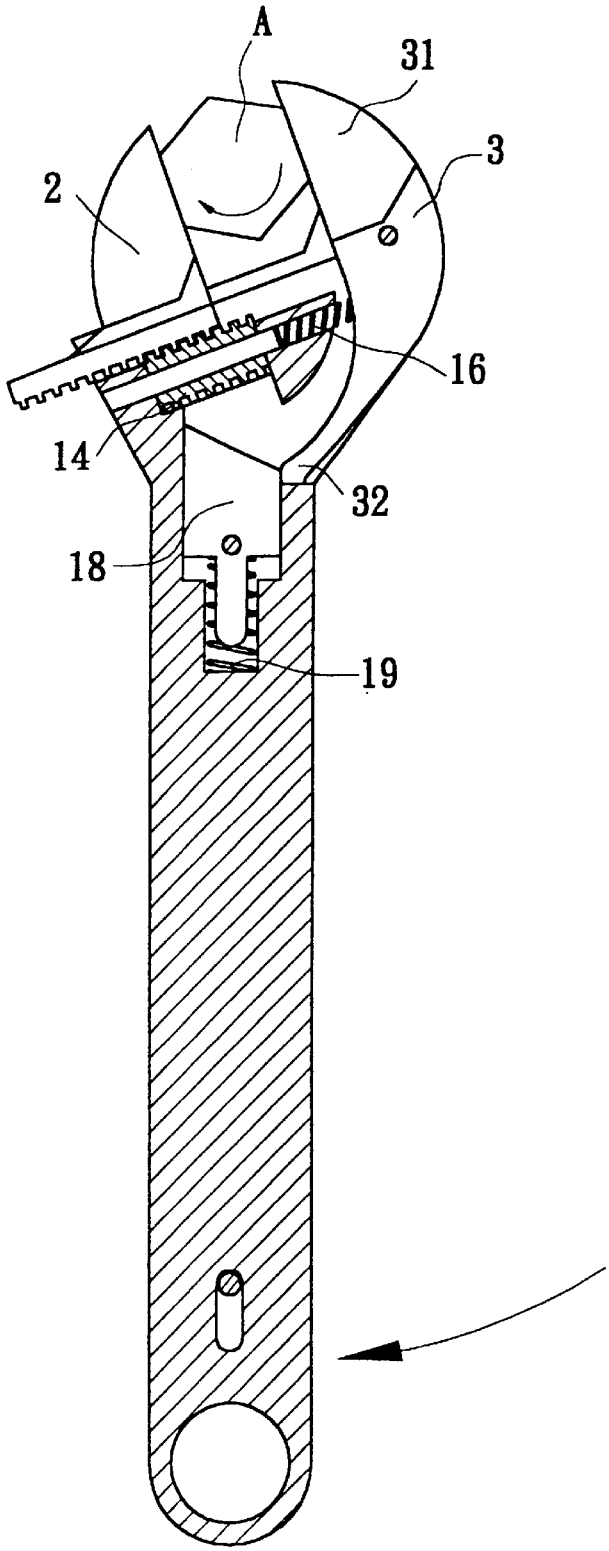
FIG. 4 shows that a bolt is wrenched by the wrench of the present invention.
Figure 5:
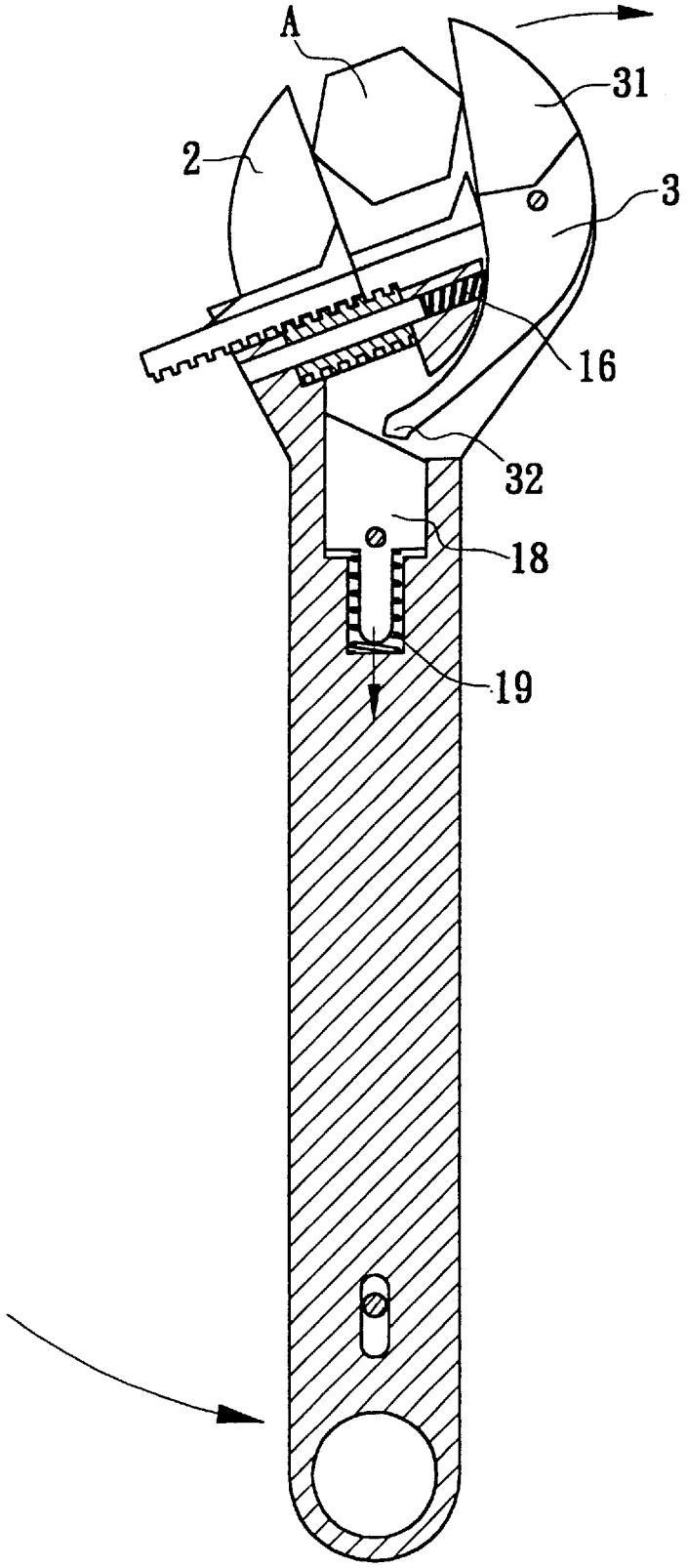
FIG. 5 shows that the bolt is reversely wrenched by the wrench of the present invention.

In use, the spiral rod 14 is first rotated to adjust the gap between the first and second jaws 2, 3, whereby the first jaw 2 and the jaw section 31 of the second jaw 3 can snugly clamp a bolt A as shown in FIG. 4. At this time, the leaning section 32 of the second jaw 3 is leant against the stop block 18 so that the second jaw 3 cannot be pivotally rotated. Under such circumstance, a user can forcedly turn the grip section 11 to wrench the bolt A. When reversely wrenching the main body 1, the slide block 113 is pushed downward to drive the stop block 18 downward. At this time, the leaning section 32 of the second jaw 3 is free from the stopping force of the stop block 18 as shown in FIG. 5 and the second jaw 3 can be pivotally rotated. When reversely turning the main body 1, the bolt A will outward drive open the jaw section 31 of the second jaw 3, whereby a sufficient space is defined between the first jaw 2 and the jaw section 31 of the second jaw 3 for avoiding the bolt A. Accordingly, the main body 1 can be reversely wrenched. When the main body 1 is wrenched to a certain position, the first spring 16 will resiliently push the second jaw 3 to restore to its home position. At this time, the jaw section 31 is leant against the stop section 102 and located. Then, the slide block 113 is released, permitting the second spring 19 to push the stop block 18 so as to drive and restore the slide block 13 to its home position. At this time, the leaning section 32 of the second jaw 3 is again stopped by the stop block 18 to restore the previous state in which the first jaw 2 and the jaw section 31 of the second jaw 3 snugly clamp the bolt A. Under such circumstance, the grip section 11 can be again turned to wrench the bolt A.

In conclusion, when the stop block 18 is moved backward, the leaning section 32 of the second jaw 3 is free from the stopping force of the stop block 18. At this time, the second jaw 3 has a space for pivotal rotation. When the second jaw 3 is pivotally rotated to move back the jaw section 31, a sufficient space is defined between the first jaw 2 and the jaw section 31 of the second jaw 3 for avoiding the bolt A. Accordingly, the wrench can be reversely wrenched.

Figure 6:
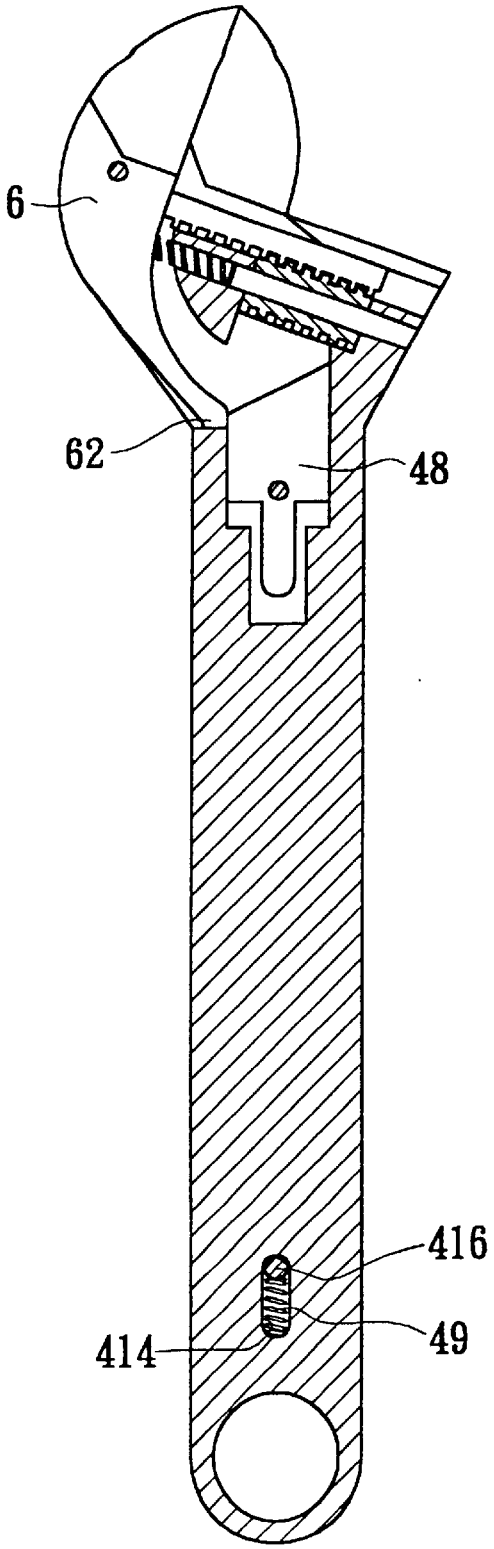
FIG. 6 is a partially sectional view of a second embodiment of the present invention.
Figure 7:
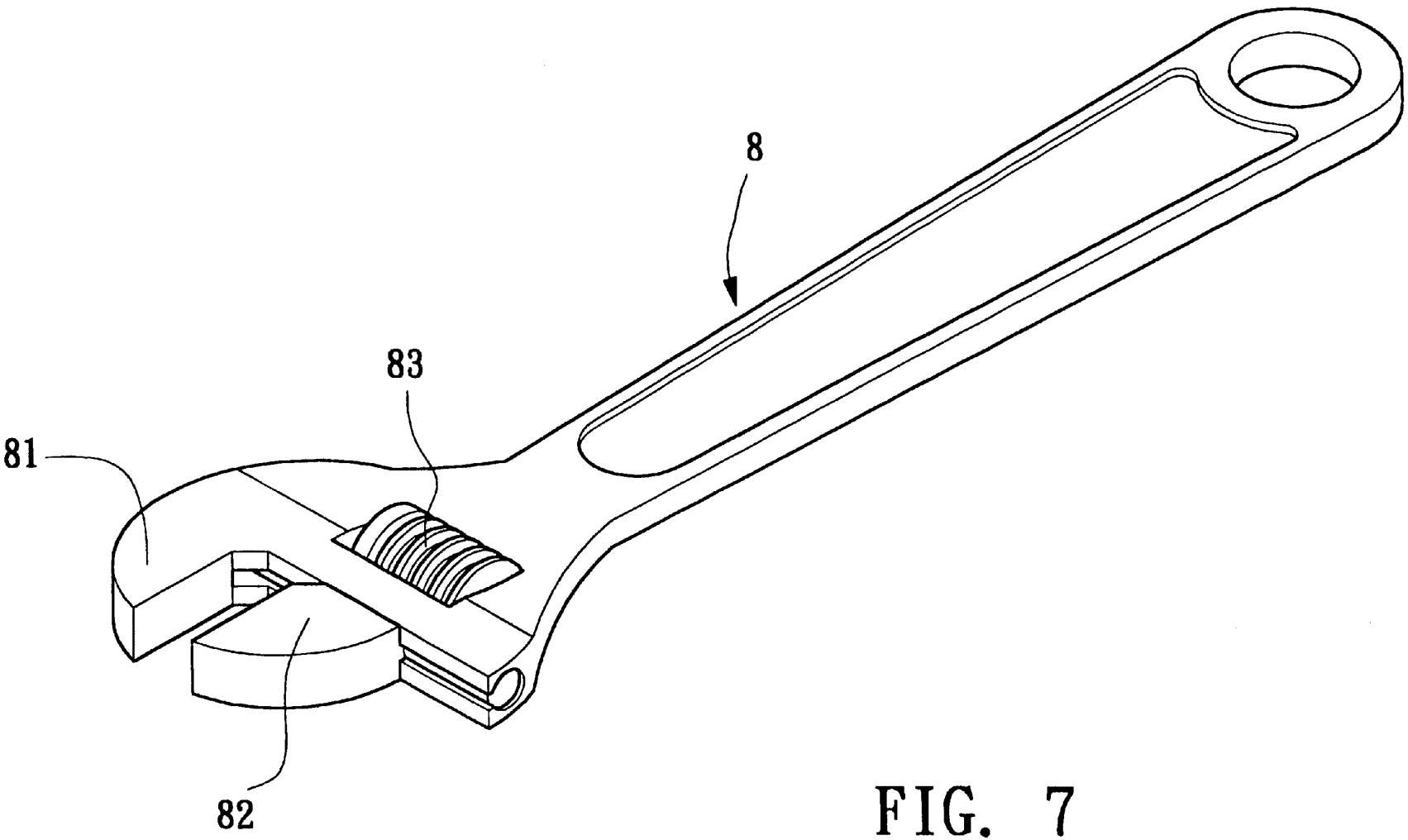
FIG. 7 PRIOR ART
FIG. 7 is a perspective view of a conventional adjustable wrench.

FIG. 6 shows a second embodiment of the present invention, in which the second spring 49 is positioned between the slot 414 and the pin member 416 for resiliently pushing the pin member 416 to drive the slide block ( not shown ) and the stop block 48. Accordingly, in normal state, the leaning section 62 of the second jaw 6 is leant against the stop block 48 to prevent the second jaw 6 from being pivotally rotated. The second embodiment can achieve the same function as the first embodiment.

The above embodiments are only used to illustrate the present invention, not intended to limit the scope thereof. Many modifications of the above embodiments can be made without departing from the spirit of the present invention.

What is claimed is:

1. A reversible adjustable wrench comprising a main body having an elongated grip section, one end of the main body opposite to the grip section being formed with a slide channel, a rack of a first jaw being fitted in the slide channel, whereby the first jaw can be slided along the slide channel, the main body being formed with a first perforation in which a spiral rod meshing with the rack is pivotally disposed, one side of the main body opposite to the first jaw being formed with a hollow section in which a second jaw is pivotally disposed, the second jaw having a jaw section extending out of one end of the hollow section opposite to the grip section, the main body has an end face opposite to the grip section, one end of the second jaw opposite to the jaw section being formed with an extending leaning section, a first resilient member being positioned between the main body and the second jaw for resiliently pushing the second jaw to pivotally rotate, whereby in normal state, the jaw section of the second jaw is always subject to a force making the jaw section mated with the first jaw, the main body being further formed with a second perforation in which a stop block is positioned, a second resilient member being placed between the stop block and a side wall of the second perforation for resiliently pushing the stop block, whereby in normal state, the leaning section of the second jaw is leant on the stop block without rotation.

2. A reversible adjustable wrench as claimed in claim 1, wherein the grip section has a substantially rectangular cross-section, at least one lateral face of the grip section being formed with a depression communicating with the second perforation, a slide block being respectively disposed in the depression, the slide block being connected with the stop block in the second perforation, whereby by means of pushing the slide block, the stop block is driven and moved.

3. A reversible adjustable wrench as claimed in claim 1, wherein the main body has an end face opposite to the grip section, a projecting stop section being formed on the end face for the jaw section of the second jaw to lean against, whereby the jaw section and the end face contain a certain angle.

4. A reversible adjustable wrench as claimed in claim 1, wherein the grip section has a substantially rectangular cross-section, two opposite lateral faces of the grip section being respectively formed with two depressions communicating with the second perforation, a slide block being disposed in each of the depressions, the slide blocks being connected with the stop block in the second perforation, one end of the grip section opposite to the second perforation being formed with a slot in the depressions, a pin member being passed through the slot to connect the two slide blocks, whereby when pushing either of the two slide blocks, the stop block is driven and moved.

5. A reversible adjustable wrench as claimed in claim 4, wherein the second resilient member is positioned between the slot and the pin member for resiliently pushing the pin member to drive the slide blocks and the stop block, whereby in normal state, the leaning section of the second jaw is leant against the stop block to prevent the second jaw from being pivotally rotated.

* * * * *